United States Patent [19]

Yannascoli

[11] Patent Number: 4,743,168

[45] Date of Patent: May 10, 1988

[54] VARIABLE CAPACITY COMPRESSOR AND METHOD OF OPERATING

[75] Inventor: Donald Yannascoli, Fayetteville, N.Y.

[73] Assignee: Carrier Corporation, Syracuse, N.Y.

[21] Appl. No.: 479,044

[22] Filed: Mar. 25, 1983

[51] Int. Cl.[4] ..... F04B 49/08

[52] U.S. Cl. ..... 417/53; 417/287; 417/288; 417/295; 417/426

[58] Field of Search ..... 417/287, 288, 295, 415, 417/419, 426, 539, 53

[56] References Cited

U.S. PATENT DOCUMENTS

| | | | |
|---|---|---|---|
| 1,738,104 | 12/1929 | Hall | 417/415 X |
| 1,969,507 | 8/1934 | Gehres | 417/295 X |
| 4,326,839 | 4/1982 | Fry et al. | 417/295 |

*Primary Examiner*—Carlton R. Croyle
*Assistant Examiner*—T. Olds
*Attorney, Agent, or Firm*—David J. Zobkiw

[57] ABSTRACT

A plurality of unloading steps for a compressor are achieved by providing the compressor with at least two cylinders having different displacements. By unloading different cylinders, the compressor output is better able to match system demand.

13 Claims, 6 Drawing Sheets

| MODE \ SOL. VALVE | 71 | 70 |
|---|---|---|
| 1/3 CAPACITY | OPEN | CLOSED |
| 2/3 CAPACITY | CLOSED | OPEN |
| FULL CAPACITY | CLOSED | CLOSED |

| MODE \ SOL. VALVE | 71' | 70' |
|---|---|---|
| 1/3 CAPACITY | CLOSED | OPEN |
| 2/3 CAPACITY | OPEN | CLOSED |
| FULL CAPACITY | OPEN | OPEN |

VARIABLE CAPACITY COMPRESSOR AND METHOD OF OPERATING

BACKGROUND OF THE INVENTION

In constant displacement compressors it is often desirable to provide a variable output. One approach has been the use of a variable speed motor to drive a constant displacement compressor. Another approach has been the unloading of one or more cylinders as by keeping the suction valve unseated during the compression stroke. Such an arrangement is complex, costly and requires pneumatic or hydraulic power elements. While these approaches work, their use has certain inherent disadvantages. When a discretely variable speed motor is used it is generally necessary to shut down the system in order to change the speed and it is necessary to keep the system off for a short period of time in order to avoid restarting against the discharge pressure. When an infinitely variable speed motor is used, an inverter is required with resultant energy loss, etc. Unloading the cylinder(s) often does not provide sufficient flexibility of operation. In a conventional single speed, two-cylinder compressor, the unloading of one cylinder gives you a choice of 100% or 50% of capacity. The structure necessary to keep the suction valves unseated often presents problems due to the need to locate the structure in or on the casing and the resultant requirement for support structure which is usually in excess of that ordinarily provided and, in the case of hermetic compressors, often requires unavailable space.

SUMMARY OF THE INVENTION

The present invention is directed to a variable capacity compressor and the method of its operation. The total compressor displacement is the sum of all of the individual cylinder displacements. By providing a constant displacement compressor with unequal displacements in some, or all, of the cylinders, several compressor unloading steps will result depending upon the displacement of the cylinder unloaded. As a specific example, in a single speed, two-cylinder compressor where one cylinder has twice the displacement of the other, the capacity can be 100%, 67% or 33% depending upon which, if any, cylinder is unloaded. The use of more cylinders gives an even wider choice of capacity. Also, the use of a two-speed motor in combination with unequal displacements would expand the choice of capacities even further.

Rather than controlling the suction valve directly, the present invention blocks the suction intakes or inlets leading to two, or more, cylinders to provide unloading. This interrupts the flow to the cylinder(s) rather than pumping the fluid in and out of the supply side as in the case where the suction valve is maintained unseated. Cylinder unloading is achieved by actuating a valve, typically a solenoid, to build up the pressure acting on a control piston which in turn closes a piston valve to shut off the suction intake. The solenoid valve may be actuated in response to a system input such as from a thermostat or suction line pressure or the control may come from a microprocessor in response to sensed system conditions such as cooling demand, space temperature, etc.

It is an object of this invention to provide a variable output for a constant displacement compressor.

It is a further object of this invention to provide a method and apparatus for variably unloading a compressor.

It is an additional object of this invention to provide a method and apparatus for changing the loading of an operating compressor.

It is another object of this invention to provide a suction cutoff unloader mechanism.

It is a further object of this invention to provide a method and apparatus for providing a greater number of steps of loading than the number of cylinders. These objects, and others as will become apparent hereinafter, are accomplished by the present invention.

Basically, a compressor is provided with unequal displacements in some, or all, of the cylinders. A suction cutoff loader mechanism is provided for stopping the suction flow to the individual cylinders to thereby unload the cylinder. Valve means are provided for positioning selected control pistons in response to thermostatic or system signals whereby the control pistons are actuated to block suction flow to selected cylinders in accordance with system demand.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
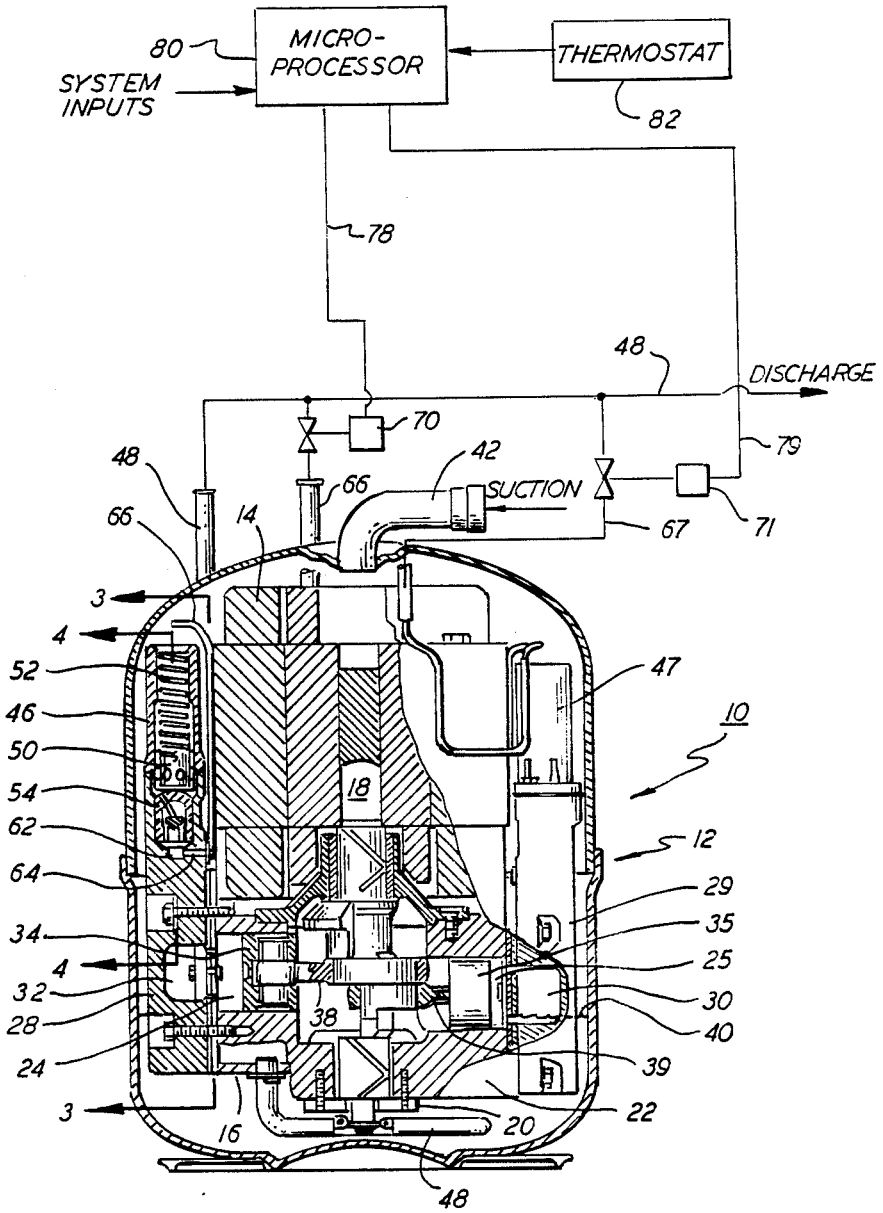
FIG. 1 is a vertical, partially sectioned view of a hermetic motor-compressor unit incorporating the present invention.
Figure 2:
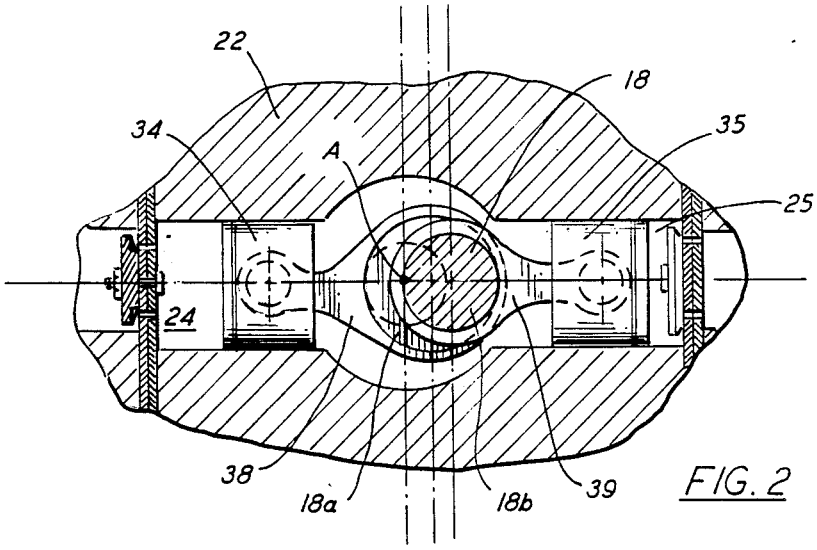
FIG. 2 is a partial sectional view of the crankshaft and strap assemblies.

The present invention will now be specifically described in terms of a two-cylinder hermetic motor-compressor unit of an opposed cylinder configuration. Referring now to FIGS. 1 and 2, the numeral 10 generally designates a hermetic motor-compressor unit incorporating the teachings of the present invention. Unit 10 includes casing or shell 12, electric motor 14, and compressor 16, with both the electric motor and the compressor disposed within the shell 12. Electric motor 14 is preferably a single speed motor but may be a conventional two-speed motor if a greater range of capacity is necessary, or desirable. In a manner well known in the art, motor 14 is employed to rotate eccentric crankshaft 18 which extends downward through compressor 16 and is supported by the thrust plate 20. Compressor 16 includes cylinder block 22 which defines cylinders 24 and 25. Cylinder heads 28 and 29 enclose cylinders 24 and 25, respectively, and each defines a suction plenum 30 and a discharge plenum 32 as is well known in the art. Pistons 34 and 35 are located within cylinders 24 and 25, respectively, for reciprocal movement therein. Pistons 34 and 35 are connected to the eccentric portions 18*a* and 18*b*, respectively, of crankshaft 18 by strap assemblies 38 and 39, respectively, whereby rotation of the crankshaft 18 about axis A causes the desired reciprocating movement of pistons 34 and 35. Although the bores of cylinders 24 and 25 are the same, the strap assemblies 38 and 39 are not identical, as best shown in FIG. 2, and the crankshaft 18 has two unequal eccentric portions 18*a* and 18*b*, thus the displacement of cylinders 24 and 25 are not the same for reasons that will be explained in detail hereinafter. Lubricant 40 is stored in a reservoir or sump defined by shell 12 and is circulated to the crankshaft bearing surfaces by the pump contained within the crankshaft 18.

Refrigerant vapor is supplied via suction line 42 and passes over and thereby cools motor 14. The refrigerant vapor then enters cylinder intakes 46 and 47, feeding cylinder heads 28 and 29, respectively. Compressed refrigerant passes from discharge plenums 32 into discharge line 48 and is discharged from unit 10.

Figure 3:
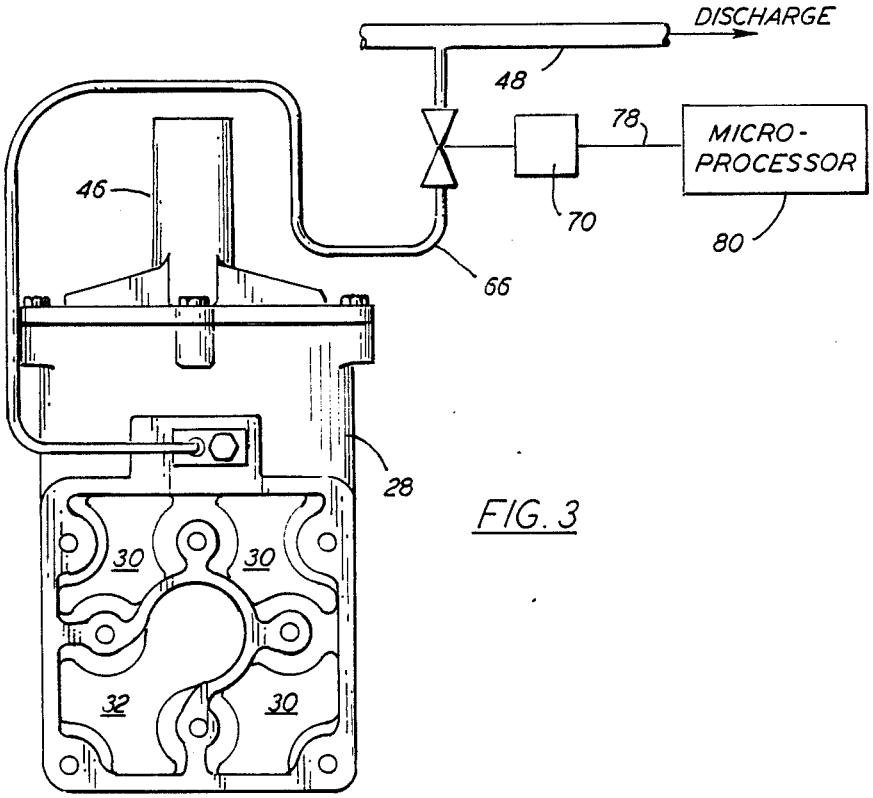
FIG. 3 is a view taken along line 3—3 of FIG. 1.
Figure 4:
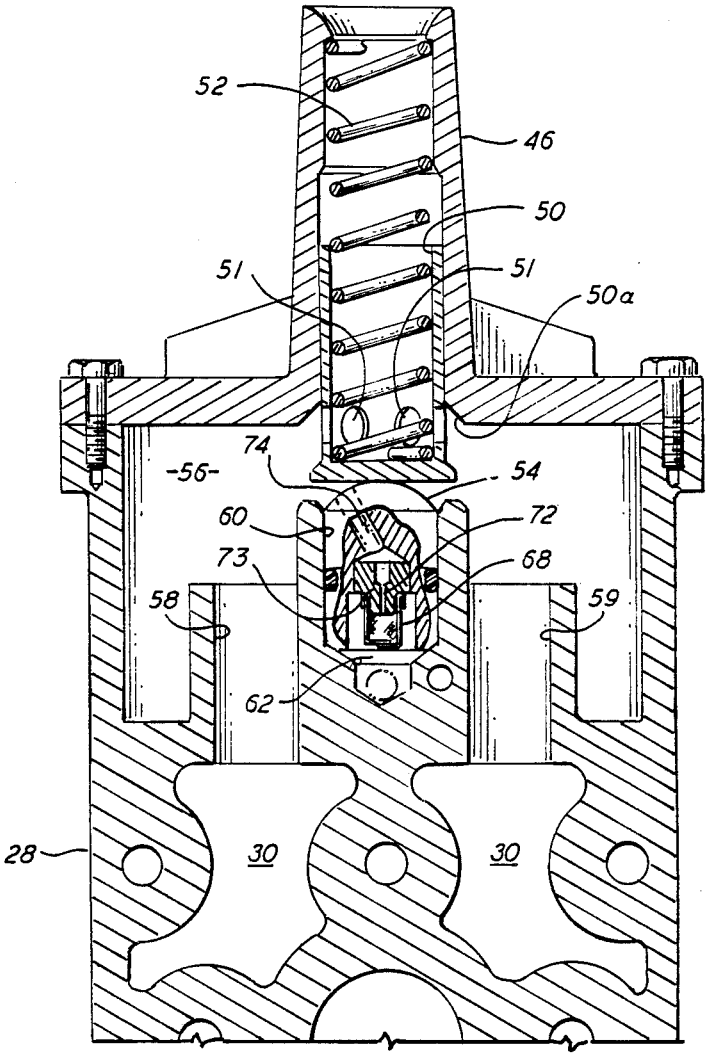
FIG. 4 is a view taken along line 4—4 of FIG. 1.

Referring now to FIGS. 3 and 4, the cylinder head 28 and cylinder intake 46, which together make up a suction cut off unloader mechanism, will now be described in greater detail, however, it should be noted that this description also applies to cylinder head 29 and its cylinder intake 47. A normally open piston valve 50 having a plurality of ports 51 is located in cylinder intake 46 and is biased in an opening direction, and off of seat 50*a* by spring 52. Valve 50 extends into cylinder head 28 where it engages control piston 54. Cylinder intake 46 and cylinder head 28 together define chamber 56 of the suction cut off unloader mechanism which communicates with suction plenum 30 via passages 58 and 59. Control piston 54 is located in a bore 60 defined in cylinder head 28, and bore 60, together with the end of control piston 54 opposite valve 50, defines a control piston chamber 62. As is best seen in FIG. 1, control piston chamber 62 is in communication with fluid pressure supply line 66 via bore 64. Restricted fluid communication can take place between control piston chamber 62 and chamber 56 via strainer 68, bore 72 in orifice plug 73 and bore 74 in control piston 54. Bore 72 is of capillary dimensions, with 0.014 inches being a typical diameter, and therefore provides a slow bleed of pressurized fluid from chamber 62 to chamber 56 and thereby suction plenum 30 when the pressure in chamber 62 is greater than the pressure in chamber 56, i.e., only when the piston valve 50 is closed.

Referring now to FIGS. 1 and 3, fluid pressure supply lines 66 and 67 connect discharge line 48 with the suction cut off unloader mechanisms defined by cylinder head 28 and cylinder intake 46, and by cylinder head 29 and cylinder intake 47, respectively. Solenoid valves 70 and 71 are located in fluid pressure supply lines 66 and 67, respectively, and are operatively connected to a microprocessor 80 via lines 78 and 79, respectively. Microprocessor 80 receives inputs from thermostat 82 as well as any other system inputs such as suction line pressure.

In operation, valves 70 and 71 will be under the control of microprocessor 80. At full compressor output for unit 10, the valves 70 and 71 will be closed and the lines 66 and 67 between valves 70 and 71 and the cylinder heads 28 and 29, respectively, will be at essentially suction plenum pressure. Referring specifically to line 66, the fluid pressure equalizes therein via bore 64, control piston chamber 62, bore 72 and bore 74 into chamber 56 which is in free fluid communication with the suction plenum 30 via passages 58 and 59. The bias of spring 52 acting on valve 50 forces control piston 54 into bore 60 to permit the uncovering of ports 51 and to permit the suction line 42 to communicate with suction plenum 30 when line 66 is not pressurized. As noted earlier, the cylinders 24 and 25 containing pistons 34 and 35, respectively, have different displacements which can be selected to meet design requirements. If, for example, cylinder 25 has twice the displacement of cylinder 24, unloading only cylinder 24 will result in a nominal capacity of 67% while unloading cylinder 25 but keeping cylinder 24 at full load will result in a nominal capacity of 33%. As microprocessor 80 senses a reduction in demand from a thermostatic signal indicating overcooling (or overheating as in the case of the electric heat pump) of the zone or in response to system suction pressure changes (e.g. overcooling will cause the suction pressure to decrease), microprocessor 80 initially unloads cylinder 24 by opening valve 70 while maintaining valve 71 closed. This can take place without stopping the compressor. The compressor output will then be at 67% of its full capacity. Upon further reduction in demand, valve 70 will be closed by microprocessor 80 and valve 71 will be opened. This takes place without stopping and results in compressor output of 33% of full capacity. The pressure will bleed from line 66 in a couple of seconds via structure corresponding to bore 72. As demand changes, microprocessor 80 will open and close valves 70 and 71 to provide 100%, 67% or 33% of full output as conditions demand. If motor 14 is a two speed motor, the microprocessor will regulate the speed of motor 14 as well as the cylinder loading.

The opening of valve 70 permits refrigerant at discharge pressure to serially pass from discharge line 48 through valve 70, line 66 and bore 64 into control piston chamber 62. In chamber 62 it acts on control piston 54 against the bias of spring 52 to cause valve 50 to move into cylinder intake 46 and seat on seat 50*a* thereby cutting off ports 51 and thus the supply of refrigerant vapor. High pressure fluid bleeds from chamber 62 via strainer 68, bore 72 and bore 74 into chamber 56 and thence into suction plenum 30. The amount of fluid bled from chamber 62 has no significant effect on the output of piston 34 which is nominally zero.

Figure 5:
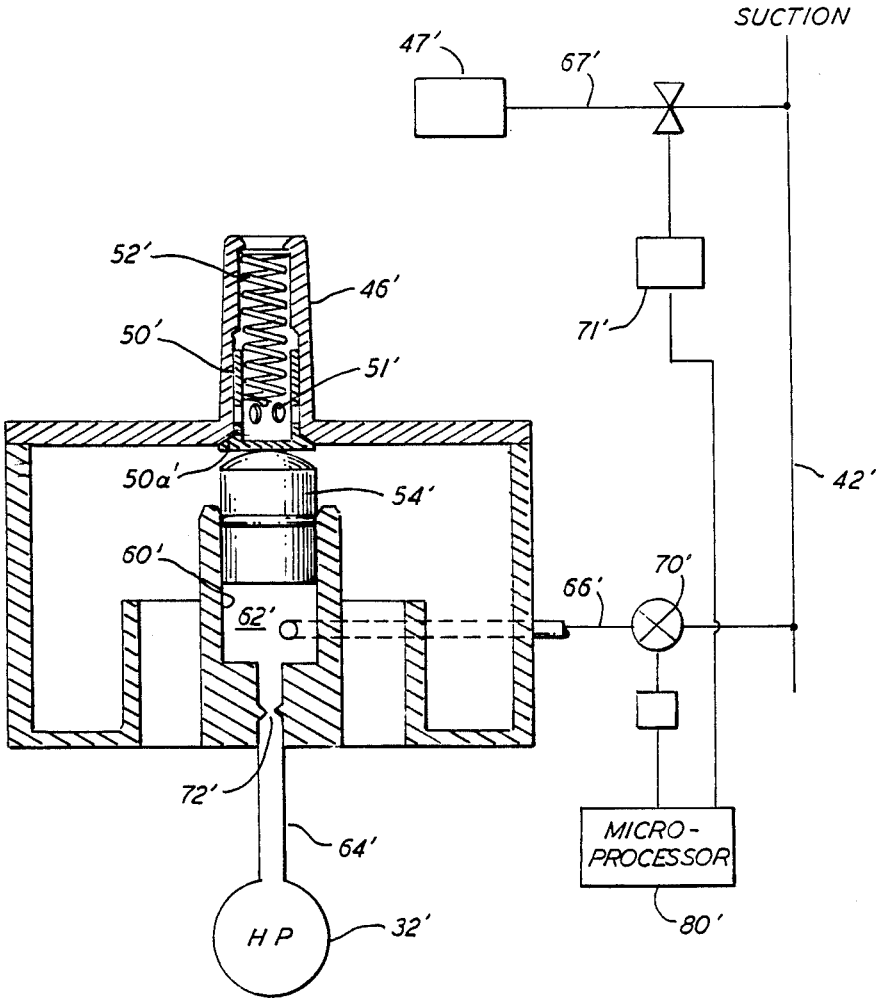
FIG. 5 is a view of a modified suction cut off unloader mechanism.

A modified suction cut off unloader mechanism 46′ is shown in FIG. 5 wherein modified structure is indicated by adding a prime to the numbers used for corresponding structure in FIGS. 1–4. High pressure refrigerant is supplied to piston chamber 62′ from discharge plenum 32′ via passage 64′ and restriction 72′. The high pressure refrigerant acts on control piston 54′ to cause it to engage valve 50′ and move it against the bias of spring 52′ onto seat 50*a*′ to thereby cause the covering of ports 51′ when solenoid valve 70′ is closed. When valve 70′ is opened by microprocessor 80′ as in response to a sensed pressure level in suction line 42′; refrigerant is free to flow from chamber 62′ via line 66′ into the suction line 42′. Because of restriction 72′, the pressure in chamber 62′ cannot be maintained when valve 70′ is open and spring 52′ acting on valve 50′ forces it against control piston 54′ and causes control piston 54′ to move in bore 60′ thereby permitting ports 51′ to be uncovered and

BEST AVAILABLE COPY thus permitting the flow of refrigerant to the suction plenum. Suction flow to unloader mechanism 47' is similarly controlled by opening and closing solenoid valve 71' under the control of microprocessor 80'. Other than having an opposite response to the opening and closing of valves 70' and 71' from that of valves 70 and 71, the system of FIG. 5 operates the same as that of FIGS. 1–4.

Figure 6:
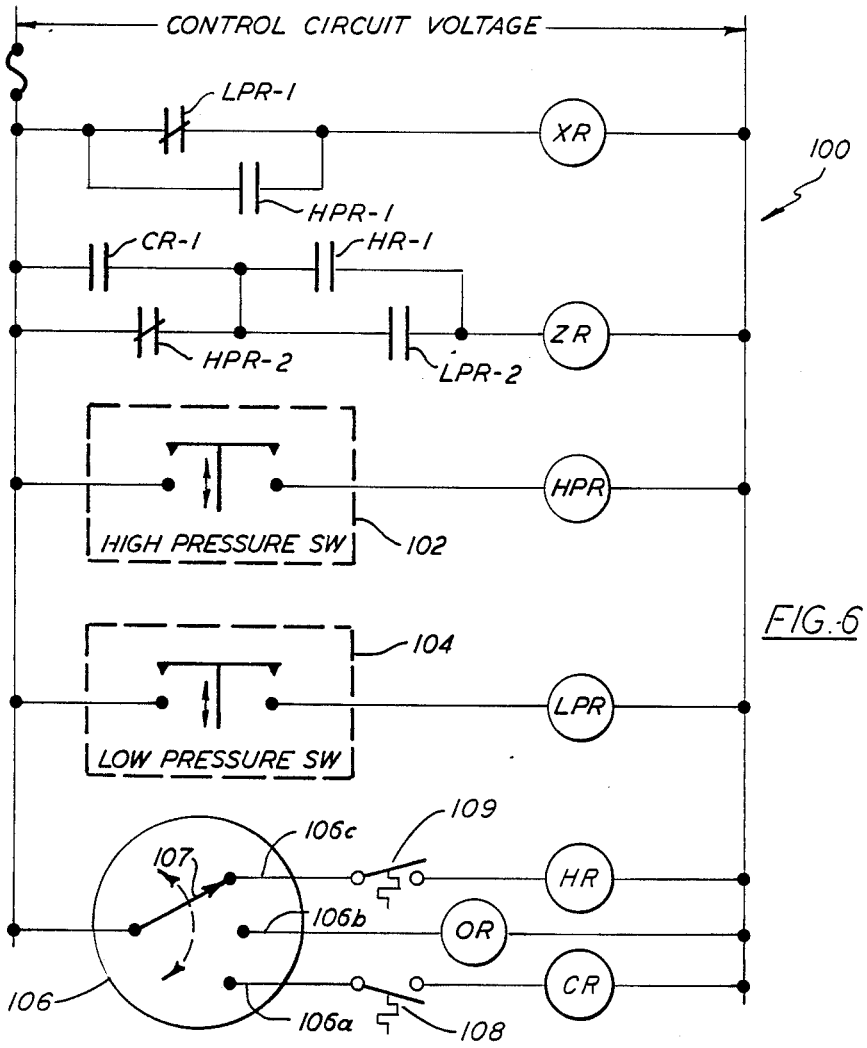
FIG. 6 is a schematic diagram of a modified control system.

As an alternative to the use of microprocessors 80 and 80', a control system 100 incorporating two adjustable pressure switches acting in response to changes in the system suction pressure can be electrically configured as illustrated in FIG. 6. Additionally, the FIG. 6 circuit will include either the structure of FIG. 7 to control the unloader of FIGS. 1–4 or will include the structure of FIG. 8 to control the unloader of FIG. 5. The control system 100 is generally applicable to electric heat pumps where the environmental air space is either heated or cooled as desired. Further, this control scheme will function automatically without intervention once the mode selection is established. In a corresponding microprocessor controlled system the mode would be determined automatically responsive to ambient temperature, zone temperature, thermostatic setting, etc.

In systems where changes in the suction pressure are sensed for the purposes of establishing the heating or cooling load, it is generally understood that in instances where cooling is desired, an increase in suction pressure corresponds to an increase in load and, therefore, requires increased system/compressor capacity. Correspondingly, a drop in suction pressure requires reduced system/compressor capacity.

However, if heating is desired, the suction pressure will decrease in a typical air source heat pump as the outdoor ambient temperature decreases, indicating that increased heating of the air space is required. As will be explained in greater detail hereinafter, control system 100 provides increased compressor capacity as suction pressures increase above preset levels when functioning in the cooling mode, whereas, in the heating mode, decreased compressor capacity will result.

Figures 9, 10, 11:
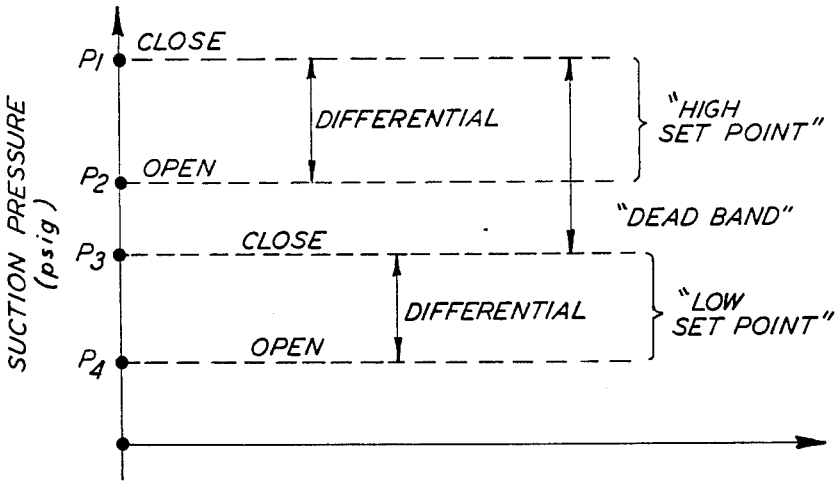
FIG. 9 is a graphical representation of the pressure switch actuation.
FIG. 10 is a chart of the actuation of solenoid valves for the circuit of FIG. 7.
FIG. 11 is a chart of the actuation of solenoid valves for the circuit of FIG. 8.

Referring to FIG. 9 it can be seen that high pressure switch 102 and low pressure switch 104 are preset at differing operating levels or closing set points that do not overlap. As a result, a dead band is purposely provided for narrow band control while still compensating for system transients that may occur during switching and tolerances that exist in the pressure switch itself. In operation, switches 102 and 104 will be closed if suction pressure exceeds $P_1$ and will be open if the suction pressure falls below $P_4$. Once either pressure switch opens, i.e. falls below the preset differential, it will not reset or close until the suction pressure exceeds the highest setting for that switch. In the dead band area, i.e. where $P_s$, the suction pressure, is $P_3<P_s<P_1$, the high pressure switch 102 will stay closed until the suction pressure drops below $P_2$ at which point it opens and will remain open until $P_s \geqq P_1$. The low pressure switch 104 remains closed until the suction pressure falls below $P_4$ and then opens and remains open as long as $P_s<P_3$.

Figure 7:
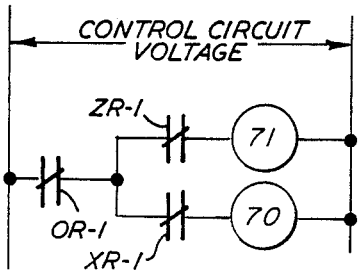
FIG. 7 is the solenoid valve control for the unloader of FIGS. 1–4 when controlled by the circuit of FIG. 6.
Figure 8:
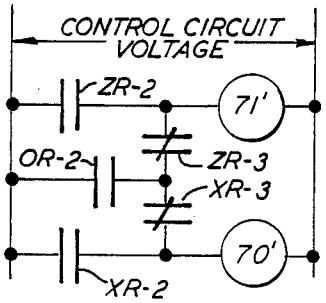
FIG. 8 is the solenoid valve control for the unloader of FIG. 5 when controlled by the circuit of FIG. 6.

In operation, the mode selection switch 106 of control system 100 is set in either the "heating", "cooling" or "override" mode. In the cooling mode, contact 107 of switch 106 engages contact **106*a* thereby powering the coil of cooling relay CR, when cooling thermostat 108 is closed, which closes normally open contacts CR-1. This in turn leaves heating relay HR unpowered which leaves normally open contacts HR-1 open and override relay OR unpowered which leaves normally closed contacts OR-1 closed or normally open contacts OR-2 open. If the system suction pressure is above $P_1$, switches 102 and 104 are closed thus actuating high pressure relay HPR and low pressure relay LPR. HPR closes normally open contacts HPR-1 and opens normally closed contacts HPR-2. LPR opens normally closed contacts LPR-1 and closes normally open contacts LPR-2. This results in powering relays XR and ZR. Relay XR opens normally closed contacts XR-1 if the configuration of FIGS. 1–4 and 7 is being controlled and closes normally open contacts XR-2 and opens normally closed contacts XR-3 if the configuration of FIGS. 5 and 8 is being controlled. Similarly, relay ZR opens normally closed contacts ZR-1 in the configuration of FIGS. 1–4 and 7 and closes normally open contacts ZR-2 and opens normally closed contacts ZR-3 in the configuration of FIGS. 5 and 8. The opening of contacts ZR-1 and XR-1 in the circuit of FIG. 7 leaves solenoid valves 70 and 71 unpowered, and therefore closed, resulting in full compressor capacity. Similarly in the circuit of FIG. 8, the closing of contacts ZR-2 and XR-2 and the opening of contacts ZR-3 and XR-3 powers, and thereby opens, solenoid valves 70' and 71'**, resulting in full compressor capacity.

If suction pressure falls below $P_2$, high pressure switch 102 opens thereby shutting off power to HPR which opens contacts HPR-1 and closes contacts HPR-2. The opening of contacts HPR-1 disables relay XR which causes the closing of contacts XR-1 in FIG. 7 thereby powering and opening solenoid valve 70 or the opening of contacts XR-2 and the closing of contacts XR-3 in FIG. 8 thereby disabling and thereby closing solenoid valve 70'. The opening of solenoid valve 70 or the closing of solenoid valve 70' results in the unloading of cylinder 24 which reduces compressor capacity by one third. FIGS. 10 and 11 show the position of valves 70 and 71 and valves 70' and 71', respectively.

As noted earlier once high pressure switch 102 opens it stays open as long as $P_s<P_1$. When $P_s \leqq P_4$ low pressure switch 104 opens thereby causing the disabling of LPR which causes the closing of contacts LPR-1 and the opening of contacts LPR-2. The closing of contacts LPR-1 enables relay XR and the opening of contacts LPR-2 disables relay ZR. The enabling of relay XR opens contacts XR-1 or closes contacts XR-2 and opens contacts XR-3 thereby closing valve 70 or opening valve 70'. The disabling of relay ZR causes the closing of contacts ZR-1 or the opening of contacts ZR-2 and the closing of contacts ZR-3 thereby opening valve 71 or closing valve 71'. This results in the reloading of cylinder 24 and the unloading of cylinder 25 which reduces compressor capacity to one third. Increasing the suction pressure to $P_3$ will reverse the process causing the compressor to go up to two thirds capacity. A rise of suction pressure to $P_1$ will bring the compressor back to full capacity.

When switch 106 engages contact **106*c* and heating thermostat 109 is closed, the relay HR is powered causing the closing of contacts HR-1 and reversing the order of operation. For example, if $P_s>P_1$ relays LPR, HPR and XR are on or powered and relay ZR is off. In the circuit of FIG. 7, solenoid 70 is closed and solenoid 71** is open resulting in a compressor capacity of one third. Continued reduction of the suction pressure, when in the heating mode, will stepwise load up the compressor.

As noted earlier, FIGS. 10 and 11 summarize the system output for both system designs. Provision is also made to override the automatic features and provide maximum compressor capacity whether the system is in the heating or cooling mode. This is done by moving contact 107 of switch 106 into engagement with contact **106*b* thereby powering relay OR to open contacts OR-1 in the FIG. 7 circuit or to close contacts OR-2 in the FIG. 8 circuit thereby overriding the relays XR and ZR. Although not illustrated, an override feature could be incorporated by using a timer relay to automatically provide faster cooling or heating for a predetermined length of time after which circuit 100** will then be activated to control system operation until the room thermostat is satisfied. If not, relay OR can be activated manually to speed up heating or cooling of the space.

Although the present invention has been specifically described in terms of a two-cylinder unit of opposed cylinder configuration, it should be obvious that the present invention is applicable to radial and in-line configurations as well. Also, the number of cylinders can be increased and the displacement changed by changing the bore and/or the stroke. When the desired operation is known from design criteria, the programming of a microprocessor is a routine task. It is therefore intended that the scope of the present invention is to be limited only by the scope of the appended claims.

What is claimed is :

1. A method for obtaining a plurality of different outputs from a compressor comprising the steps of:
- rotating a crankshaft to drive at least two pistons having different cylinder displacements; and
- selectively controlling flow to the suction side of at least two piston cylinders having different cylinder displacements to selectively unload and reload the cylinders to vary compressor output according to demand.

2. A motor-compressor unit comprising:
- motor means;
- a crankshaft operatively connected to said motor means and driven thereby;
- at least two piston means including piston cylinders having different cylinder displacements operatively connected to said crankshaft and driven thereby;
- each of said piston cylinders having fluid supply means and fluid delivery means operatively connected thereto; and
- means for selectively controlling said fluid supply means of said piston cylinders of said at least two piston means whereby said at least two piston means can be selectively loaded and unloaded to control the capacity of said motor-compressor unit.

3. The motor-compressor unit of claim 2 wherein said motor-compressor unit has only two pistons.

4. The motor-compressor unit of claim 2 wherein said means for selectively controlling said fluid supply means includes:
- normally open valve means controlling said fluid supply means to each of said piston cylinders of said at least two piston means;
- fluid pressure responsive means operatively engaging said normally open valve means; and
- means for selectively supplying fluid pressure to said fluid pressure responsive means to selectively move said fluid pressure responsive means and thereby selectively close and reopen said normally open valve means.

5. The motor-compressor unit of claim 4 wherein said means for selectively supplying fluid pressure to said fluid pressure responsive means includes:
- solenoid valve means; and
- control means for selectively actuating said solenoid valve means to thereby vary the capacity of said motor-compressor unit in accordance with the demand.

6. The motor-compressor unit of this claim 2 wherein said means for selectively controlling said fluid supply means includes:
- normally open valve means controlling said fluid supply means to each of said piston cylinders of said at least two piston means;
- fluid pressure responsive means operatively engaging said normally open valve means;
- means for supplying fluid pressure to said fluid pressure responsive means to move said fluid pressure responsive means and thereby close said normally open valve means; and
- means for selectively removing said fluid pressure to permit said normally open valve means to open and thereby permit flow in said fluid supply means.

7. The motor-compressor unit of claim 2 wherein said motor means is a single-speed electric motor.

8. The motor-compressor unit of claim 2 wherein said motor means is a two-speed electric motor.

9. A motor-compressor unit comprising:
- motor means;
- a crankshaft operatively connected to said motor means and driven thereby;
- two piston means having piston cylinders of different displacements operatively connected to said crankshaft and driven thereby;
- each of said piston cylinders having fluid supply means and fluid delivery means operatively connected thereto;
- normally open valve means forming a part of each of said fluid supply means;
- fluid pressure responsive means operatively engaging each of said normally open valve means; and
- means for selectively supplying fluid pressure to said fluid pressure responsive means to move said fluid pressure responsive means to selectively close said normally open valve means and thereby selectively unload one of said piston means.

10. The motor-compressor unit of claim 9 wherein said means for selectively supplying fluid pressure to said fluid pressure responsive means includes:
- solenoid valve means for controlling the supplying of fluid pressure to each of said fluid pressure responsive means; and
- control means responsive to system demand for selectively actuating and deactuating said solenoid valve means for selectively varying the capacity of said motor-compressor unit.

11. The motor-compressor unit of claim 9 wherein said crankshaft has at least two unequal eccentrics.

12. A method for obtaining a greater number of steps of unloading to less than full capacity than the number of cylinders of a compressor comprising the steps of:
- rotating a crankshaft to drive at least two pistons having different cylinder displacements;
- selectively controlling suction flow to at least two piston cylinders having different displacements;
- blocking the suction flow to just a first cylinder to produce a first percentage of unloading; and

BEST AVAILABLE COPY blocking the suction flow to just a second cylinder having a different cylinder displacement than the first cylinder to produce a second percentage of unloading which is different than the first percentage of unloading.

13. A motor-compressor unit comprising:

motor means;

a crankshaft operatively connected to said motor means and driven thereby;

at least two pistons means including piston cylinders wherein one of said at least two piston means has a cylinder displacement which is twice that of the other one of said at least two piston means, each of said at least two piston means being operatively connected to said crankshaft and driven thereby;

each of said piston cylinders having fluid supply means and fluid delivery means operatively connected thereto; and means for selectively controlling said fluid supply means of said piston cylinders of said at least two piston means where by said at least two piston means can be selectively loaded and unloaded to control the capacity of said motor-compressor unit.

* * * * *